US007717521B2

(12) United States Patent
Hall et al.

(10) Patent No.: US 7,717,521 B2
(45) Date of Patent: May 18, 2010

(54) METAL DETECTOR FOR AN ASPHALT MILLING MACHINE

(76) Inventors: David R. Hall, 2185 S. Larsen Pkwy., Provo, UT (US) 84606; David Wahlquist, 2185 S. Larsen Pkwy., Provo, UT (US) 84606; Neil Cannon, 2185 S. Larsen Pkwy., Provo, UT (US) 84606

( * ) Notice: Subject to any disclaimer, the term of this patent is extended or adjusted under 35 U.S.C. 154(b) by 3 days.

(21) Appl. No.: 11/774,635

(22) Filed: Jul. 9, 2007

(65) Prior Publication Data

US 2009/0016818 A1 Jan. 15, 2009

(51) Int. Cl.
*E01C 23/00* (2006.01)

(52) U.S. Cl. ..... 299/1.5; 404/84.05

(58) Field of Classification Search ..... 299/1.5, 299/1.05, 39.4; 404/84.05
See application file for complete search history.

(56) References Cited

U.S. PATENT DOCUMENTS 3,996,510 A * 12/1976 Guichard ..... 327/510
4,507,612 A * 3/1985 Payne ..... 324/329
4,929,121 A * 5/1990 Lent et al. ..... 299/1.5
5,607,205 A * 3/1997 Burdick et al. ..... 299/1.5
5,786,696 A 7/1998 Weaver
7,077,601 B2 7/2006 Lloyd
2003/0034778 A1* 2/2003 Nelson ..... 324/329
2005/0175412 A1* 8/2005 Lloyd ..... 404/77

FOREIGN PATENT DOCUMENTS

JP 07294652 A * 11/1995

* cited by examiner

*Primary Examiner*—John Kreck
(74) *Attorney, Agent, or Firm*—Tyson J. Wilde; Benjamin T. Miskin; Philip W. Townsend, III

(57) ABSTRACT

A milling machine for milling a paved surface has milling tools connected to an underside of a body of the machine. At least one ferrous metal detector is attached to a front end of the machine. Electronic equipment is disposed within the machine and is in communication with the metal detector, the equipment being adapted to interpret feedback from the detector.

19 Claims, 8 Drawing Sheets

METAL DETECTOR FOR AN ASPHALT MILLING MACHINE

BACKGROUND OF THE INVENTION

The current invention relates to milling machines for milling asphalt or concrete in roads, sidewalks, parking lots, or other paved surfaces. While milling and resurfacing a paved surface, the milling machines often encounter metal objects which are covered partially or completely by the paved surface such as manhole covers or railroad tracks. In such circumstances, if the metal object isn't detected beforehand, the object, milling tools on the milling machine, or both may be damaged. In order to avoid this, a metal detector may be used to detect the objects before milling the paved surfaces. It may also be advantageous to know the size and depth of the metal objects. Some inventions of the prior art disclose metal detectors in combination with a pavement resurfacing machine.

U.S. Pat. No. 7,077,601 to Lloyd, which is herein incorporated by reference for all that it contains, discloses a machine for providing hot-in-place recycling and repaving an existing asphalt-based pavement, in which the pavement is first heated.

U.S. Pat. No. 5,786,696 to Weaver et al., which is herein incorporated by reference for all that it contains, discloses a metal detector which utilizes digital signal processing and a microprocessor to process buffers of information which is received at a periodic rate. The metal detector is able to determine the depth of a target by comparing the quadrature phase components received from first and second receive antennas. The size of the target is determined by reference to a look-up table based on the depth factor and the signal amplitude determined for the target object.

BRIEF SUMMARY OF THE INVENTION

In one aspect of the invention, a milling machine for milling a paved surface has milling tools connected to an underside of a body of the machine. At least one ferrous metal detector is attached to a front end of the machine. Electronic equipment is disposed within the machine and is in communication with the metal detector, the equipment being adapted to interpret feedback from the detector.

A detection range of the metal detector may be controlled by a variable voltage source. The metal detector may be adapted to determine a depth of a metal object. The metal detector may be adapted to determine the size of a metal object. The metal detector may be adapted to detect metal objects up to 1 foot deep. The metal detector may be vertically adjustable. The metal detector may be attached to the front end such that during operation the detector is positioned from 1 to 8 inches above the paved surface. The milling tools may be adapted to be automatically laterally adjusted in a closed loop system by the electronic equipment in response to feedback from the detector.

The metal detector may comprise a magnetic shielding intermediate the metal detector and the body, such that the detector is magnetically shielded from the body. The magnetic shielding may be made of a material selected from the group consisting of ferrite, aluminum oxide, chromium, nickel, copper, iron, molybdenum, alloys thereof, and any combination thereof. The magnetic shielding may be attached to the underside of the body. The magnetic shielding may comprise a relative magnetic permeability of at least 100. The magnetic shielding may focus a magnetic field from the detector in a predetermined direction. The magnetic shielding may comprise an open housing with a cross-section comprising a partial rectangular geometry, a partial polygonal geometry, a partial circular geometry, a partial elliptical geometry, a planar geometry, a u-shaped geometry, or any combination thereof. The metal detector may also be magnetically shielded from the milling tools. At least a portion of the detector may be disposed within the housing.

The machine may comprise at least two metal detectors positioned such that a detection range of a first detector extends farther into the surface than a detection range of a second detector. The machine may comprise a plurality of ferrous metal detectors arranged in a plurality of arrays, each array positioned at a different distance above the paved surface. The machine may comprise a plurality of ferrous metal detectors positioned at different angles.

In another aspect of the invention, a method for metal detection during milling of a paved surface comprises the steps of providing a milling machine having milling tools connected to an underside of a body of the machine and at least one ferrous metal detector attached to a front end of the machine; providing electronic equipment disposed within the machine and in communication with the metal detector, the equipment being adapted to interpret feedback from the detector; and applying a variable voltage to the detector, allowing the detector to detect metal objects over various ranges of depths.

DETAILED DESCRIPTION OF THE INVENTION AND THE PREFERRED EMBODIMENT

Figure 1:
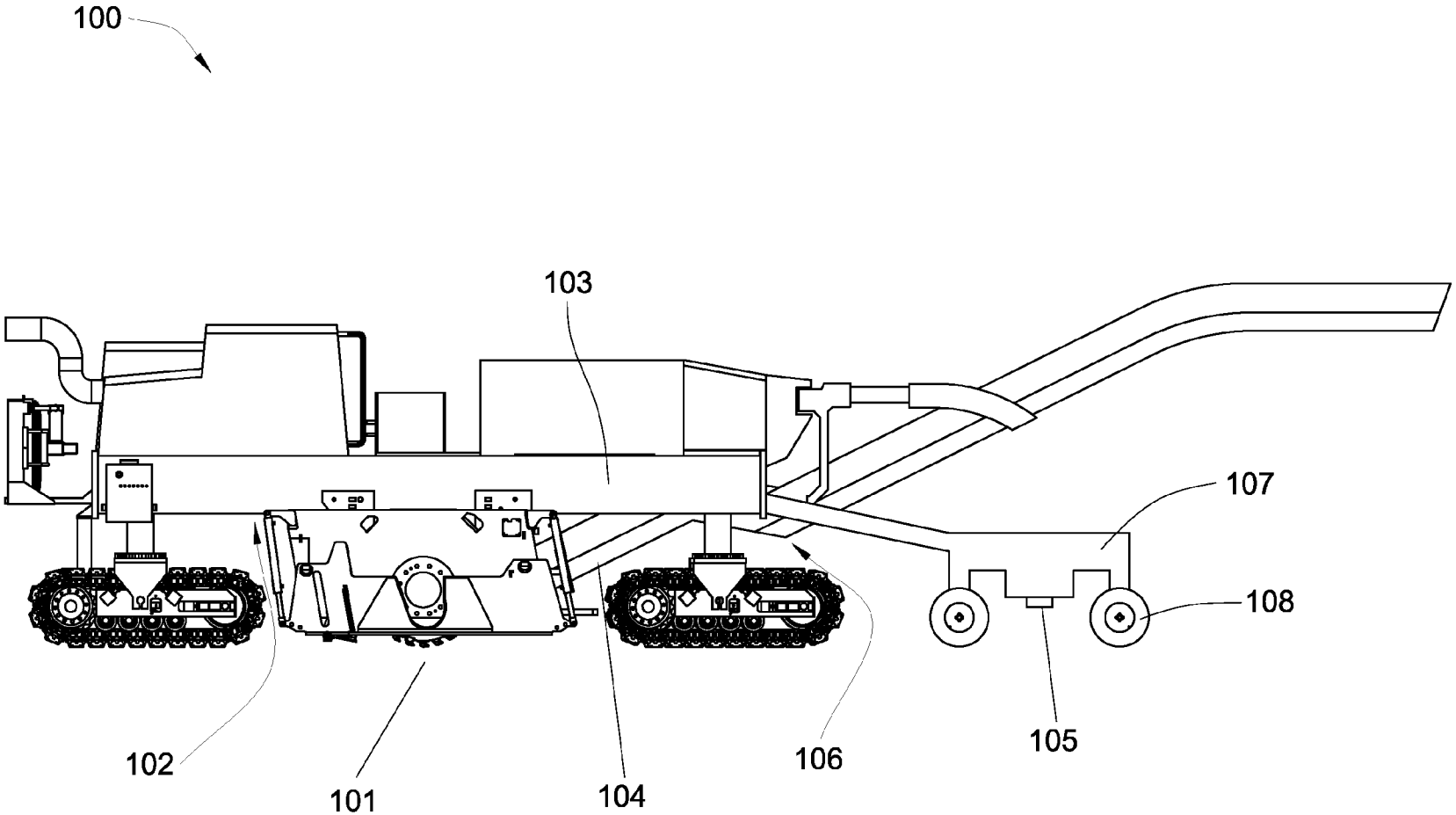
FIG. 1 is a perspective diagram of an embodiment of a milling machine.
Figure 2:
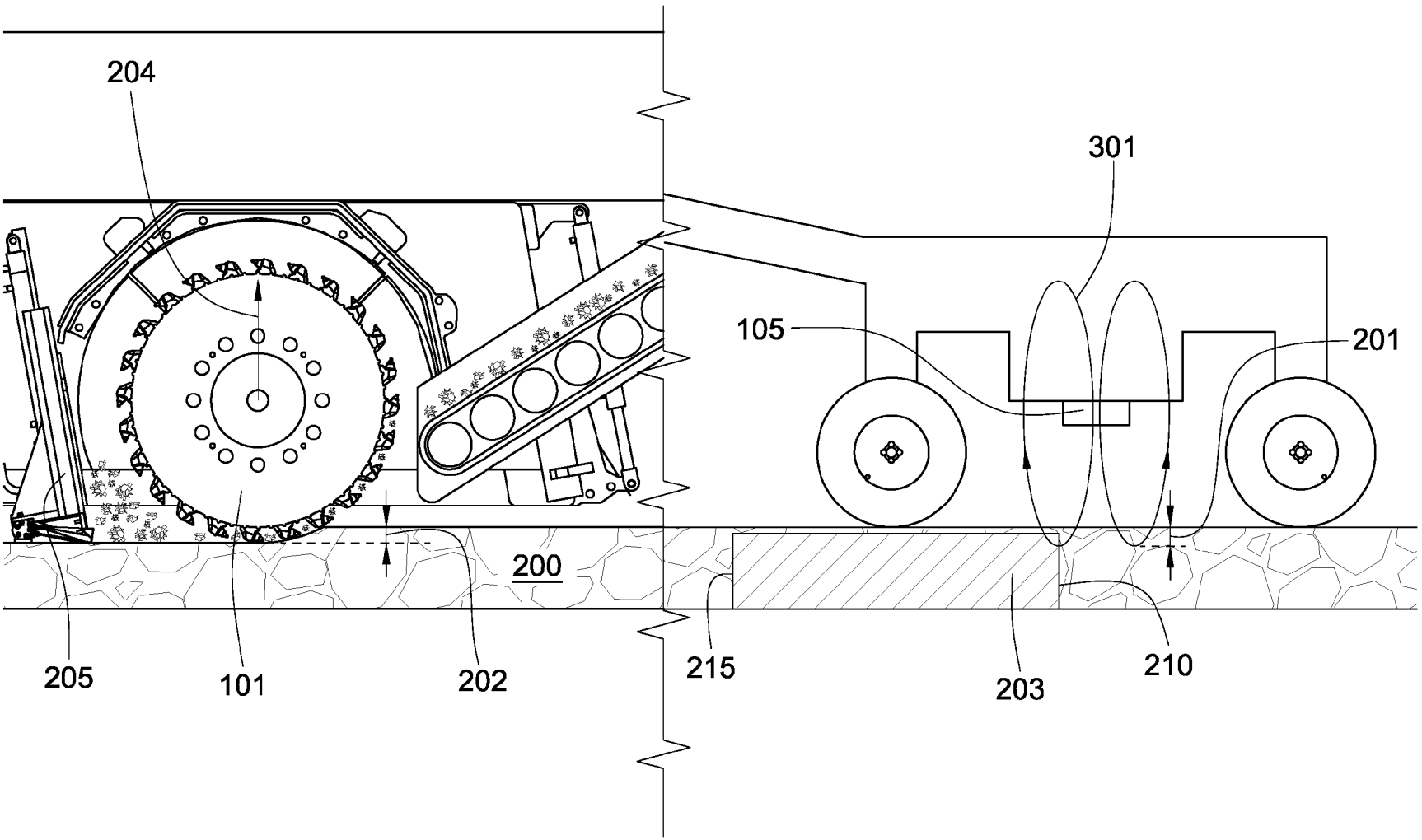
FIG. 2 is a cross-sectional diagram of another embodiment of a milling machine.

FIG. 1 depicts a milling machine 100 which may be used to remove asphalt or concrete from a paved surface (see No. 200 in FIG. 2). Milling tools 101 such as a milling drum are attached to an underside 102 of a body 103 of the milling machine 100. A conveyer 104 is adapted to lift the millings off the surface. Typically the millings are loaded into a bed of a truck (not shown) where the millings may be hauled away.

The milling machine 100 also comprises at least one ferrous metal detector 105 attached to a front end 106 of the machine 100 adapted to detect ferrous metal objects, such as manhole covers, in the paved surface at a predetermined detection depth. The detector 105 may be attached at a distance far enough away from a body 103 of the machine 100 such that metal in the body 103 doesn't interfere with the metal detector 105. The machine may comprise an extension 107 on the front end 106 of the machine 100 to which the metal detector 105 may be attached. The extension 107 may comprise wheels 108 and may be pivotally attached to the body 103, which may allow the extension 107 to move along the paved surface such that the detector 105 may maintain a constant height above the paved surface.

Referring now to FIG. 2, the detection depth 201 of the metal detector 105 may be fixed based on a cutting depth 202 of the milling tools 101. After the cutting depth 202 of the milling tools 101 is set, the detection depth 201 of the metal detector 105 may be set at or below the cutting depth 202, such that the metal detector 105 may detect ferrous metal objects 203 which may interfere with the cutting of the milling tools 101. The sensitivity of the metal detector 105 may also be adjustable such that only metal objects 203 large enough to affect the milling may be detected. The detector 105 may be positioned from 1 to 8 inches above the paved surface. In some embodiments, the metal detector 105 may be adapted to detect metal objects 203 up to 1 foot deep. In other embodiments, the metal detector 105 may be adapted to detect metal objects 203 up to 3 feet deep. The detector 105 may also be adapted to determine the size of the objects.

The detector 105 may emit a magnetic field 301 which extends into the surface 200. As the detector 105 passes over a metal object 203, the magnetic field 301 may induce a magnetic field in the object 203, depending on the material of the metal object 203. The detector 105 may then be able to detect the change in the magnetic field of the object 203, which may indicate a first edge 210 of the object 203. As the metal detector 105 continues to pass over the object 203, the magnetic field of the object 203 may remain constant until the field 301 of the detector 105 reaches a second edge 215 of the object 203, in which instance the magnetic field of the object 203 changes again and is sensed by the detector 105. In such instances, the detector 105 may be able to determine the size of the object 203. In embodiments where the object 203 comprises first and second edges 210, 215 proximate each other, the detector 105 may only briefly induce a magnetic field in the object 203.

When a metal object 203 is detected which may interfere with the milling tools 101, the milling tools 101 may be raised such that the milling tools 101 pass over the metal object 203, as indicated by the vertical arrow 204, which may prevent damage to the metal object 203 and/or the milling tools 101. Other components such as a moldboard 205 may be raised to prevent damage as well. The components may be manually controlled by a machine operator or it may be automatically controlled by electronic equipment in a closed-loop system.

Figure 2A:
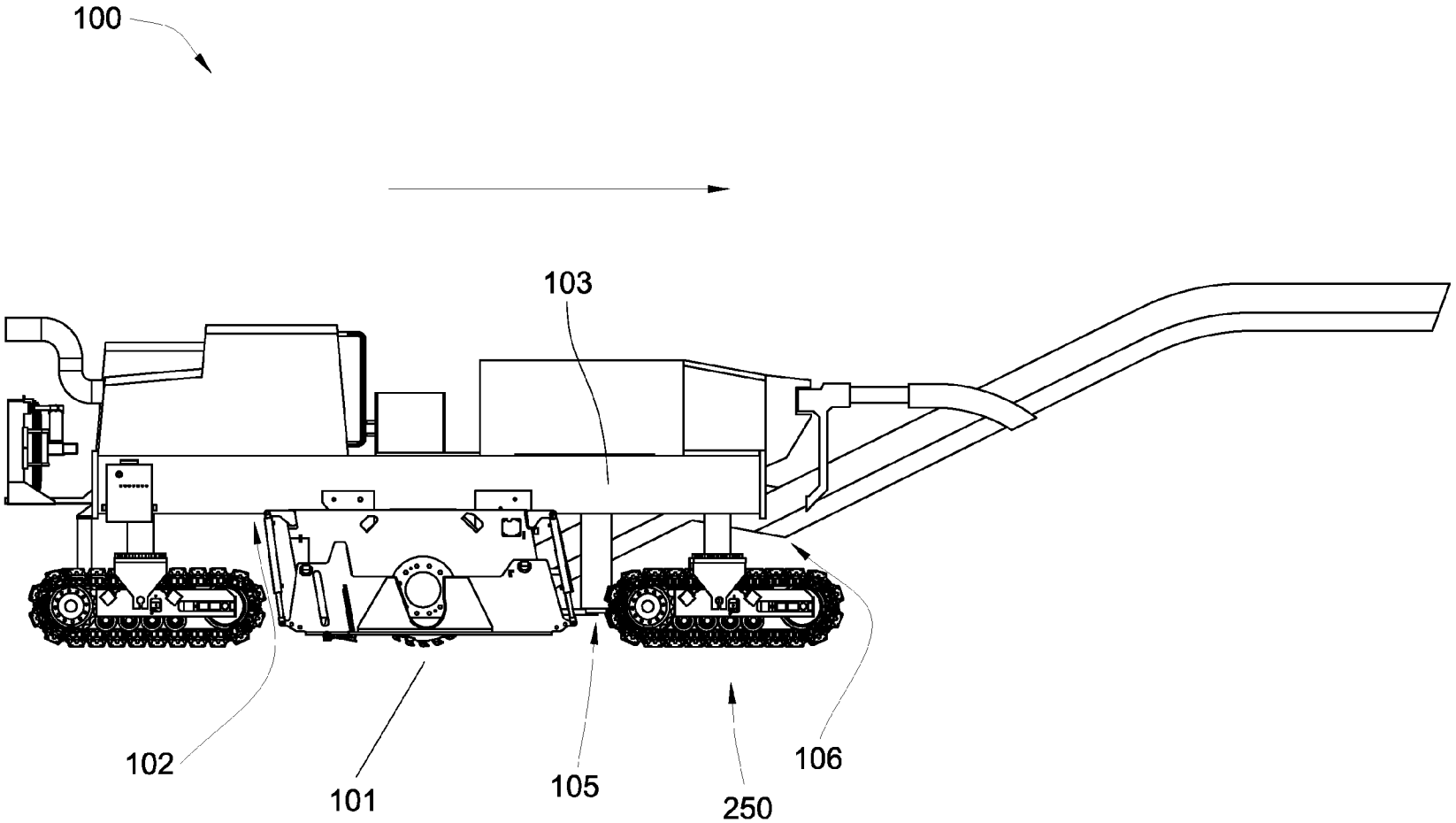
FIG. 2*a* is a perspective diagram of another embodiment of a milling machine.
Figure 3:
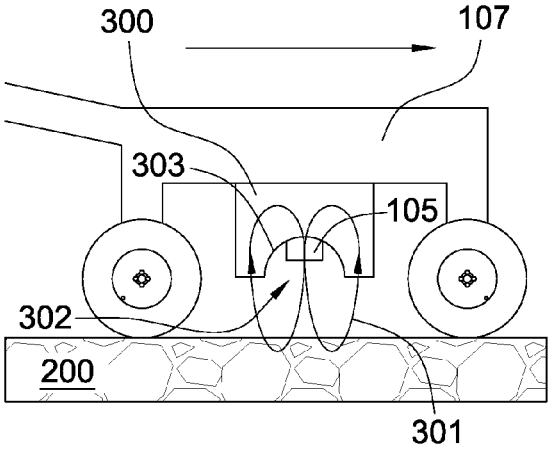
FIG. 3 is an orthogonal diagram of an embodiment of a metal detector.
Figure 4:
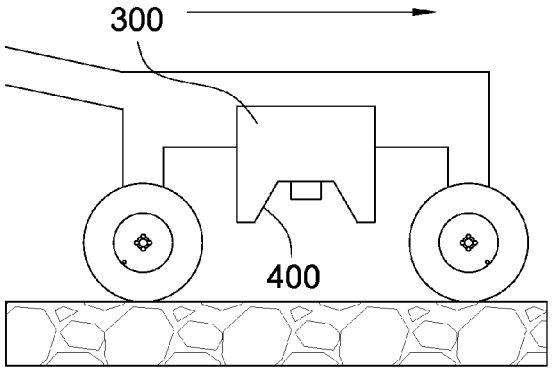
FIG. 4 is an orthogonal diagram of another embodiment of a metal detector.
Figure 5:
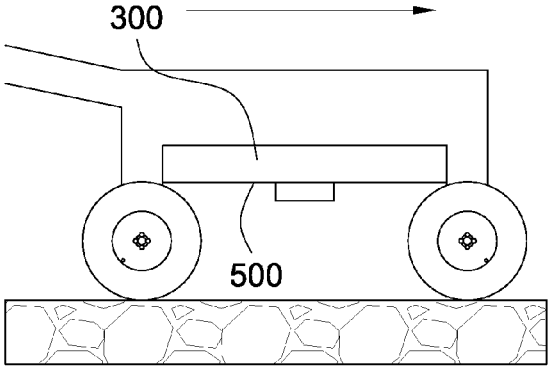
FIG. 5 is an orthogonal diagram of another embodiment of a metal detector.

FIG. 2*a* is another embodiment of the milling machine with the detector 105 positioned between the front tracks 250 and the milling tools 101. In some embodiments, the detector may be positioned between the front tracks. Shielding, such as the shielding described in FIGS. 3-8 may be used to shield the affects from the milling tools, tracks, and frame of the milling machine. In some embodiments, the shielding may include an aluminum mesh cloth.

The detector may also be raised and lowered to maintain a constant distance from the paved surface. Sensors which may include SONAR, lasers, or optics, may be used to determined the distance. The detector may be repositioned through a closed loop system or it may be repositioned manually. In some embodiments, the position of the detector may be controlled hydraulically or electrically.

The machine 100 may comprise a magnetic shielding 300 intermediate the metal detector 105 and the body 103, such that the detector is magnetically shielded from the body 103, as in the embodiments of FIGS. 3 through 6. The magnetic shielding may be attached to the extension 107. The shielding 300 may be adapted to focus a magnetic field 301 from the detector 105 in a predetermined direction. The shielding 300 may also shield the detector 105 from the extension 107, which may allow electronics to be disposed within the extension 107. The extension 107 may also be made of a non magnetic material. The magnetic shielding 300 may comprise an open housing 302 with a cross-section comprising a partial circular geometry 303, a partial polygonal geometry 400, a planar geometry 500, a partial rectangular geometry 600, a partial elliptical geometry, a u-shaped geometry, or any combination thereof. At least a portion of the detector 105 may be disposed within the housing 302.

The shielding 300 may be made of a material selected from the group consisting of ferrite, aluminum oxide, chromium, nickel, copper, iron, molybdenum, alloys thereof, and any combination thereof. The shielding may comprise a relative magnetic permeability of at least 100. In some embodiments the relative magnetic permeability may be 2,000 to 30,000. Preferably, the relative magnetic permeability is large enough that the shielding prevents substantially all of the magnetic field of the detectors from metal objects on the machine.

Figure 6:
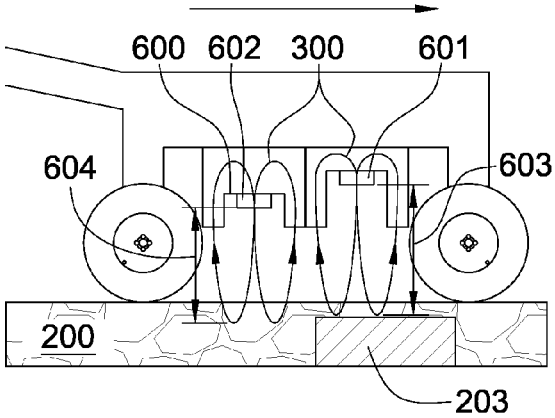
FIG. 6 is an orthogonal diagram of another embodiment of a metal detector.

The machine 100 may comprise a plurality of detectors 601, 602 positioned at different distances above the paved surface 200, as in the embodiment of FIG. 6. As each detector 601, 602 passes over the metal object 203, the detectors 601, 602 may or may not detect the object 203, depending on the detection range 603, 604 of each detector 601, 602 and its distance above the surface 200. This may allow the detectors 601, 602 to determine a depth of the metal object 203. A first detector 601 may have a detection range 603 which is unable to detect the object 203, whereas a second detector 602 may have a range 604 which is able to detect the object 203. From this information, a general depth of the object 203 may be extrapolated. The accuracy of the information may be increased with more detectors. The machine may also comprise a plurality of detectors positioned at a same distance above the paved surface, but calibrated such that each detector has a different detection range, which may allow the detectors to determine the depth of the object. The detectors may also detect the object at a first power level, and then at subsequent power levels of greater or lower magnitude to determine the depth at which the object may be buried. If the depth is greater than the depth of cut of the milling tools then a decision may be made to mill over the object since the milling tools won't engage the object. However, if the object is determined to be within the depth of cut a decision to stop milling, raise the milling tools, or automatically shut off the milling machine may also be made. These decisions may be made manually or electronically through a closed loop system.

Figure 7:
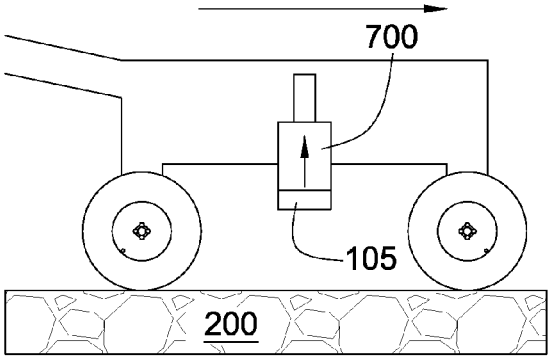
FIG. 7 is an orthogonal diagram of another embodiment of a metal detector.
Figure 8:
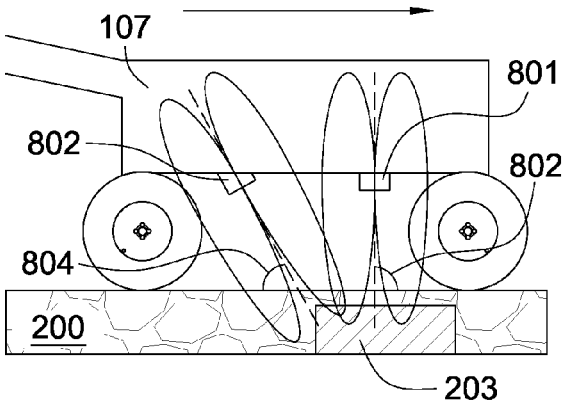
FIG. 8 is an orthogonal diagram of another embodiment of a metal detector.

The metal detector 105 may be attached to a translatable arm 700, as in the embodiment of FIG. 7. The arm 700 may be vertically adjusted such that the detection range of the detector 105 reaches the desired detection depth This may also be advantageous for determining the depth of objects in the surface 200.

Another method for determining the depth of metal objects may be triangulation. The machine may comprise a plurality of detectors 801, 802 positioned at different angles, as in the embodiment of FIG. 8. A first detector 801 may be positioned on the extension 107 at a first known angle 803 with respect to the surface 200, while a second detector 802 may be positioned at a second known angle 804 with respect to the surface 200. The extension 107 may also comprise more detectors positioned at other angles for better accuracy. A plurality of detectors 801, 802 may also make it easier to determine the size of the object 203 and/or its shape.

Figure 9:
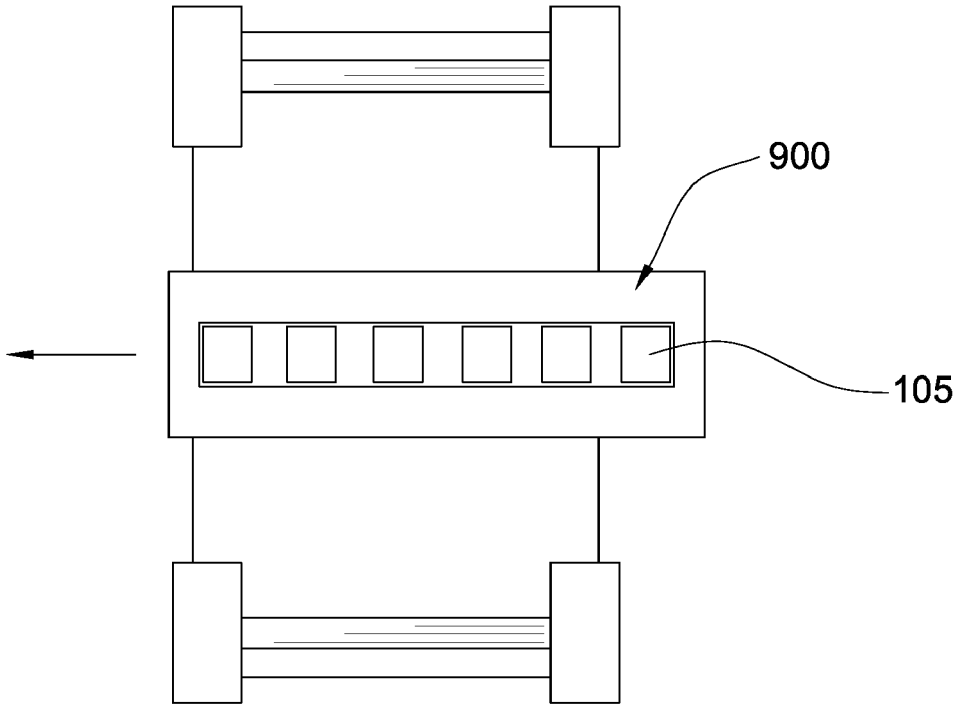
FIG. 9 is an orthogonal diagram of another embodiment of a metal detector.
Figure 10:
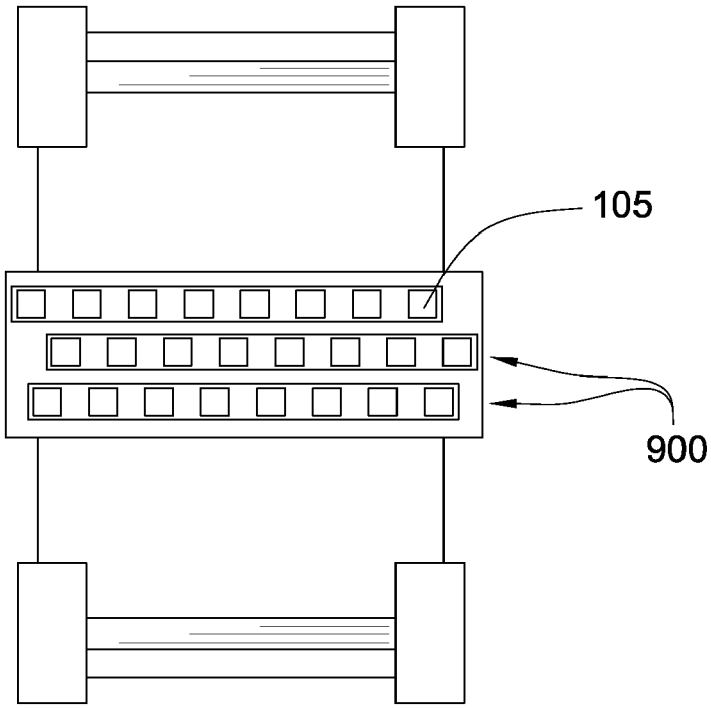
FIG. 10 is an orthogonal diagram of another embodiment of a metal detector.

The machine may comprise a plurality of detectors 105 arranged in an array 900, as in the embodiment of FIG. 9. The array 900 of detectors 105 may be laterally translatable. This may allow the detectors 105 to detect metal objects over a wide pathway, such as on a road. The machine may also comprise a plurality of arrays 900 of detectors 105, as in the embodiment of FIG. 10. The arrays 900 may be staggered such that no lateral gaps are present in the cumulative detection range of all the detectors.

Figure 11:
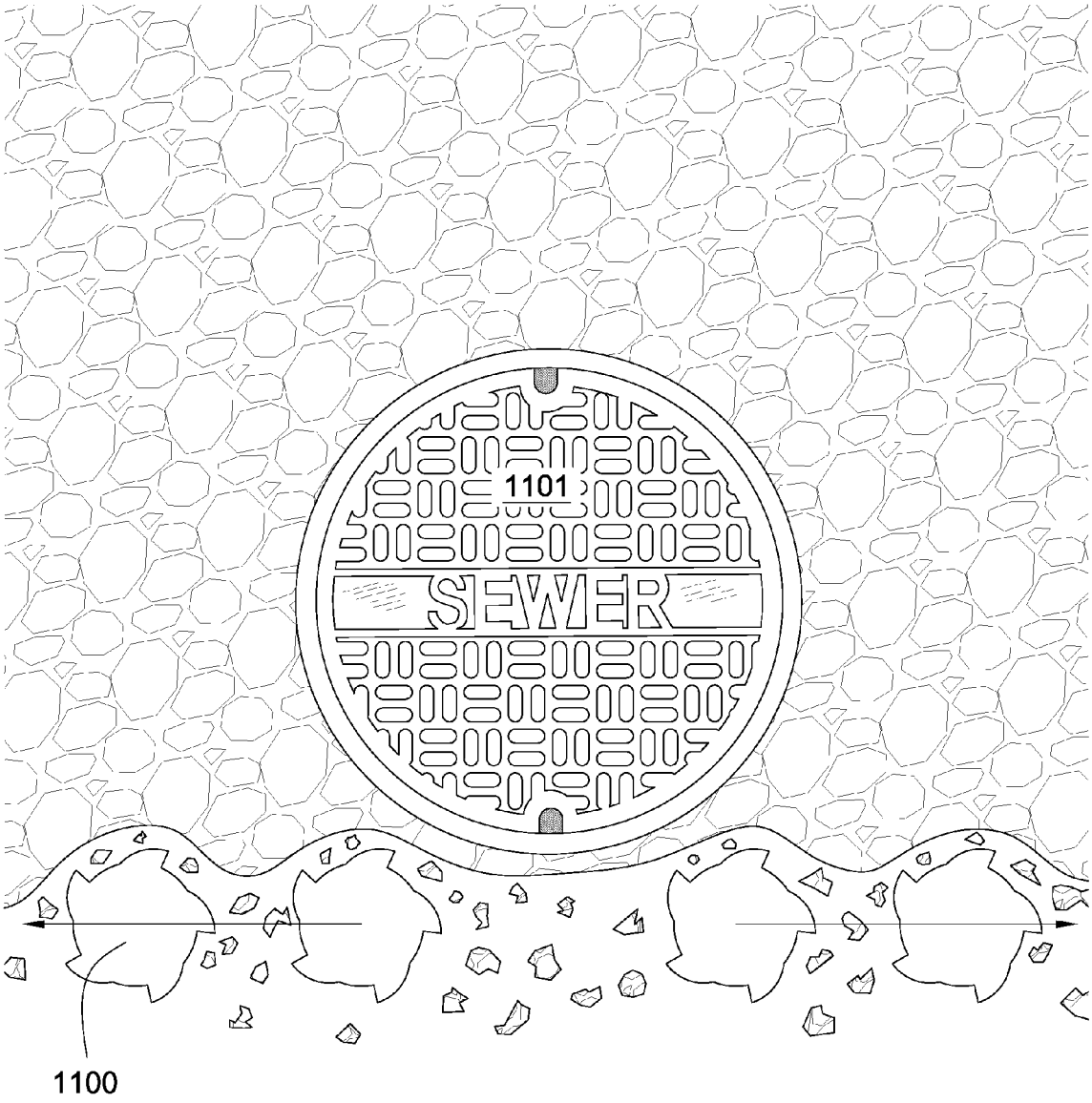
FIG. 11 is a cross-sectional diagram of an embodiment of milling tools milling a paved surface.

The present invention may be used in a milling machine comprising a plurality of rotary bits 1100 as milling tools 101, as in the embodiment of FIG. 11. The milling tools may be adapted to be automatically laterally adjusted in a closed-loop system. The detectors 105 may be in electrical communication with electronic equipment in the closed-loop system, such that feedback from the detectors may be used to automatically control the lateral positions of the milling tools. As the detectors pass over a metal object such as a manhole cover 1101, the feedback from the detectors may be interpreted by a processor and stored in memory. Sensors may be positioned on the machine to determine how far the machine travels such that the electronic equipment may be able to determine when a detected metal object reaches the milling tools. The electronic equipment may comprise a controller in electrical communication with the milling tools adapted to control the lateral movement of the milling tools such that the tools may mill around the metal object. The controller may also control the rotation of the tools. The detector may be attached to the front end of the milling machine and proximate the milling tools. The metal detector may be magnetically shielded from the milling tools in addition to being shielded from the body of the machine. The shielding may be attached to the underside of the body.

Figure 12:
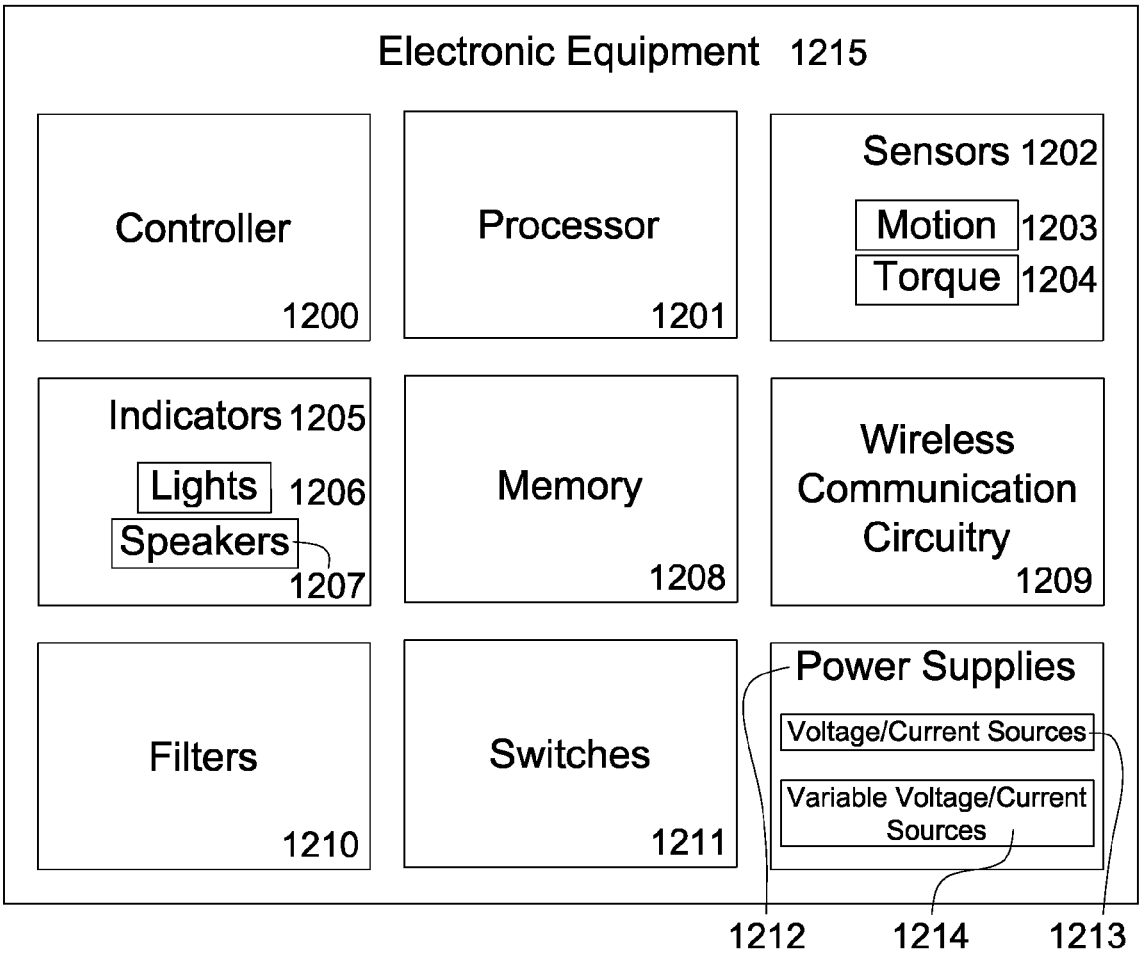
FIG. 12 is a block diagram of an embodiment of electronic equipment in a milling machine.

Referring now to FIG. 12, the electronic equipment 1215 may comprise a controller 1200; a processor 1201; sensors 1202, including motion sensors 1203 or torque sensors 1204; indicators 1205, including lights 1206 or speakers 1207; memory 1208; wireless communication circuitry 1209; filters 1210; switches 1211; or power supplies 1212, including constant or variable voltage/current sources 1213, 1214.

The controller 1200 may control the way the electronic equipment 1215 interacts with mechanical devices such as the milling tools 101 or other elements on the machine. Processors 1201 may be used to process the information and feedback from the detectors 105 or sensors 1202 such as motion sensors 1203 on the machine or torque sensors 1203 on the milling tools for use in a closed-loop system or for use by an operator. The equipment 1215 may comprise memory 1208 for storing the information for use as the machine traverses the paved surface. The information may also later be used for statistical or analytical purposes, or when repaving the surface. When a metal object is detected, indicators 1205 may alert an operator with both lights 1206 and speakers 1207. The electronic equipment 1215 may comprise wireless communication circuitry 1209 such that information gathered by the detectors 105 or sensors 1202 may be transmitted to a remote location. The equipment 1215 may comprise power supplies 1212 such as voltage or current sources 1213, 1214, which may either be constant or variable for powering the detectors 105 or sensors 1202. The equipment 1215 may also comprise filters 1210, switches 1211, or other electronic devices for performing such functions as determining the type of ferrous metal of the object.

Figure 13:
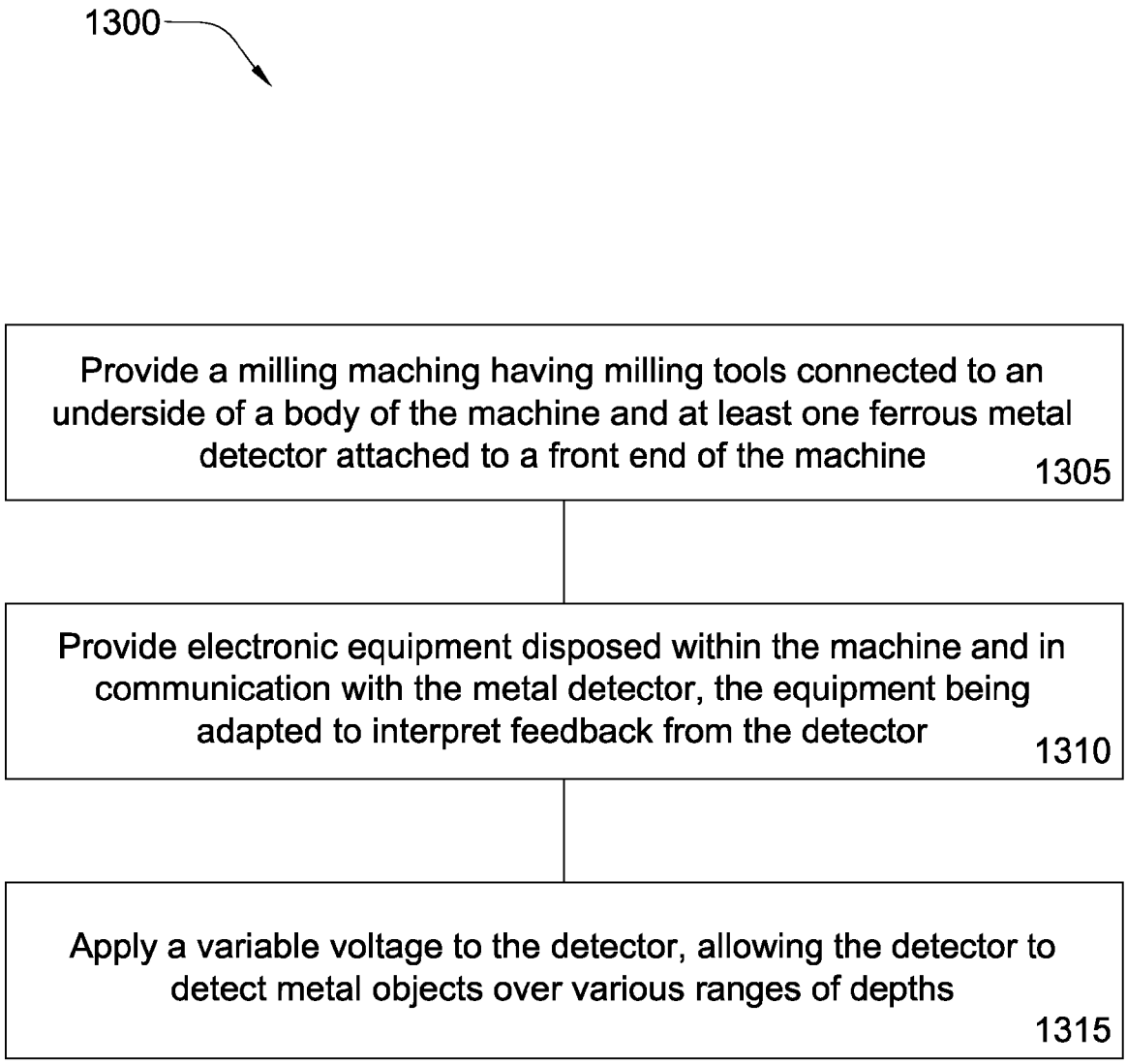
FIG. 13 is a flowchart diagram of a method for metal detection during milling of a paved surface.

FIG. 13 discloses a method 1300 for metal detection during milling of a paved surface, comprising the steps of providing 1305 a milling machine having milling tools connected to an underside of a body of the machine and at least one ferrous metal detector attached to a front end of the machine; providing 1310 electronic equipment disposed within the machine and in communication with the metal detector, the equipment being adapted to interpret feedback from the detector; and applying 1315 a variable voltage to the detector, allowing the detector to detect metal objects over various ranges of depths.

Whereas the present invention has been described in particular relation to the drawings attached hereto, it should be understood that other and further modifications apart from those shown or suggested herein, may be made within the scope and spirit of the present invention.

What is claimed is:

1. A milling machine for milling a paved surface, comprising:

milling tools connected to an underside of a body of the machine;

at least one ferrous metal detector attached to a front end of the machine;

the at least one metal detector comprises a characteristic of creating a magnetic field and detecting an induced magnetic field from metal objects; and electronic equipment in communication with the metal detector, the equipment being adapted to interpret feedback from the detector;

wherein the metal detector is adapted to determine a depth of a metal object by having at least two metal detectors at different distances from the paved surface;

wherein when the electronic equipment interprets a metal object that interferes with milling, the electronic equipment causes the milling machine to automatically shut off.

2. The machine of claim 1, wherein the machine comprises at least two metal detectors positioned such that a detection range of a first detector extends farther into the surface than a detection range of a second detector.

3. The machine of claim 1, wherein the machine comprises a magnetic shielding intermediate the metal detector and the body, such that the detector is magnetically shielded from the body.

4. The machine of claim 3, wherein the magnetic shielding is made of a material selected from the group consisting of ferrite, aluminum oxide, chromium, nickel, copper, iron, molybdenum, alloys thereof and any combination thereof.

5. The machine of claim 3, wherein the magnetic shielding is attached to the underside of the body.

6. The machine of claim 3, wherein the magnetic shielding comprises a relative magnetic permeability of at least 100.

7. The machine of claim 3, wherein the magnetic shielding focuses a magnetic field from the detector in a predetermined direction.

8. The machine of claim 3, wherein the metal detector is also magnetically shielded from the milling tools.

9. The machine of claim 3, wherein the magnetic shielding comprises a u-shaped geometry.

10. The machine of claim 1, wherein a detection range of the metal detector is controlled by a variable voltage source.

11. The machine of claim 1, wherein the metal detector is adapted to detect metal objects up to 1 foot deep.

12. The machine of claim 1, where the metal detector is adapted to determine the size of a metal object.

13. The machine of claim 1, wherein the metal detector is adapted to locate an edge of the metal object.

14. The machine of claim 1, wherein the machine comprises a plurality of ferrous metal detectors arranged in a plurality of arrays, each array positioned at a different distance above the paved surface.

15. The machine of claim 1, wherein the milling tools are adapted to be automatically laterally adjusted in a closed-loop system by the electronic equipment in response to feedback from the detector.

16. The machine of claim 1, wherein the machine comprises a plurality of ferrous metal detectors positioned at different angles.

17. The machine of claim 1, wherein the metal detector is vertically adjustable.

18. The machine of claim 1, wherein the metal detector is attached to the front end such that during operation the detector is positioned from 1 to 8 inches above the paved surface.

19. A method for metal detection during milling of a paved surface, comprising the steps of:

providing a milling machine having milling tools connected to an underside of a body of the machine and at least one ferrous metal detector attached to a front end of the machine;

providing electronic equipment disposed within the machine and in communication with the metal detector, the equipment being adapted to interpret feedback from the detector; and inducing a magnetic field in a metal object by applying a variable voltage to the detector, allowing the detector to detect metal objects over various ranges of depths;

wherein at least two metal detectors are positioned at different distances from the paved surface;

wherein when the electronic equipment interprets a metal object that interferes with milling, the electronic equipment causes the milling machine to automatically shut off.

* * * * *